US007591569B1

(12) United States Patent
Little

(10) Patent No.: US 7,591,569 B1
(45) Date of Patent: Sep. 22, 2009

(54) CHRISTMAS HOLIDAY ACCESS, INDICATOR, AND MEMENTOS KEY METHOD AND APPARATUS

(76) Inventor: Gerald Little, 1135 Hollywood Blvd., Hollywood, FL (US) 33019

( * ) Notice: Subject to any disclaimer, the term of this patent is extended or adjusted under 35 U.S.C. 154(b) by 0 days.

(21) Appl. No.: 11/782,713

(22) Filed: Jul. 25, 2007

Related U.S. Application Data

(60) Provisional application No. 60/855,602, filed on Oct. 31, 2006.

(51) Int. Cl.
*F21V 3/00* (2006.01)

(52) U.S. Cl. ..... 362/311.13; 362/311.01; 362/311.04; 362/311.06; 362/253; 362/34

(58) Field of Classification Search ..... None
See application file for complete search history.

(56) References Cited

U.S. PATENT DOCUMENTS 4,015,111 A * 3/1977 Spector ..... 362/34
5,844,472 A * 12/1998 Lee ..... 340/438
7,264,377 B2 * 9/2007 Cooper et al. ..... 362/276

* cited by examiner

*Primary Examiner*—Bao Q Truong
*Assistant Examiner*—Danielle Allen
(74) *Attorney, Agent, or Firm*—Gold & Rizvi, P.A.; Glenn E. Gold; H. John Rizvi

(57) ABSTRACT

A decorative oversized key-shaped Christmas/holiday novelty item has a plastic shell having the form of an oversized key. The shell defines a completely encapsulated interior space. A plurality of chemicals contained within the interior space, are capable of creating a chemo-luminescent reaction when combined. A top portion of the key can be twisted, functioning as a catalyst to initiate the chemo-luminescent reaction. Alternately, electrically induced lighting can replace the chemo-luminescent reaction. A recording device can be included within the holiday key such that the children can record a holiday message for Santa. The novelty item enables children living in homes absent a chimney, fireplace or other structure typically considered to provide access by Santa Claus to the home, to practice a Christmas holiday tradition relying upon such a structural access means.

20 Claims, 10 Drawing Sheets

CHRISTMAS HOLIDAY ACCESS, INDICATOR, AND MEMENTOS KEY METHOD AND APPARATUS

CROSS-REFERENCE TO RELATED APPLICATION

This patent application claims priority to Provisional Patent Application 60/855,602 filed Oct. 31, 2006, which is incorporated by reference herein.

FIELD OF THE INVENTION

The present invention relates generally to holiday novelty items. More particularly, the present invention relates to a decorative Christmas Holiday key incorporating various lighting properties, which can be hung on doors or other objects of residences without fireplaces or chimneys, in order to provide an explanation to children as to how Santa Claus is able to gain access to their homes.

BACKGROUND OF THE INVENTION

Children have believed in Santa Claus (under any the many known names) for hundreds of years. No matter what incarnation, whether it is the Magi King, Father Christmas, Saint Nicholas, etc., the tradition is still very much alive in the 21st century. One thing that has changed is children's sophistication. The Santa legend evokes images of the jolly toy maker flying with the reindeer, landing on roofs, and entering homes via chimneys to deliver treasures on Christmas Eve. The problem is that children in modern times, living in an age of apartment complexes, condominiums, and a host of other domiciles without chimneys or fireplaces, tend to be more inquisitive, and want to know just how Santa Claus will pay them a visit if they don't have chimney access. Will he have to break the door down or pick the lock and trip off the security alarm? Will their homes be bypassed and presents given to other children if Santa Claus can't find a way in?

Accordingly, there is an established need for a Christmas decoration and associated method, that in addition to remaining true to the decorative parameters of bright, festive ornamentation during the holiday season, also provides children with an explanation for Santa Claus's ability to enter their homes, allaying their fears and concerns over missing out on their presents on Christmas morning.

SUMMARY OF THE PRESENT INVENTION

The present invention is directed to a decorative Christmas Holiday key having any of a variety of lighting properties, configured to be hung easily on either a door, a window, or other like object, providing children with a magical belief as to Santa Claus's ability to deliver presents under the tree, preserving the magical history of an age-old holiday tradition.

The present invention supports a respective, inventive storyline. In today's environment, parents are spending less quality time with their children. The present invention provides a very low-tech apparatus and respective method that brings the family together as well as adding some excitement during the Christmas holiday. The family would sit together during the Christmas Eve dinner and share the story of the Holiday key. Since many residence are absent the chimney, Santa needs a different method for entering the home, hence the Holiday key. The family will decorate and illuminate the Holiday key and place the key on the door. The illumination will help Santa find the children's home. By labeling the key with the family's name, it helps ensure that Santa delivers the correct presents. When Santa arrives, he magically shrinks the key to open the door. This causes the illumination to end. Santa can optionally record a message for the children using an audio recording and playback device incorporated within the key. Santa enters the residence, places the presents under the Christmas tree, eats the milk and cookies (or other treats) provided by the children, and leaves the non-illuminated Holiday key on the counter. When the children wake in the morning, they gather around the tree to open presents and with the holiday key, the children can enjoy a personalized message from Santa. The message can be locked ensuring that it is not lost via being recorded over. The holiday key includes an audio recorder, able to record a plurality of messages, thus allowing Santa to record a new message every year. The family can share the story every year as well as passing the key on from generation to generation. Alternately, the holiday key can comprise a magical fluid, which illuminates when the key is flexed. The holiday key remains illuminated until Santa rubs the key and magically stops the glow. This would result in a collection of keys for every year that can be displayed together.

The following present various aspects of the present invention.

In one general aspect of the present invention, a decorative oversized key-shaped Christmas novelty item is provided, comprising:

a. a plastic, translucent shell having the form of an oversized key, the shell defining a completely encapsulated interior space;

b. a plurality of chemicals contained within separate sections of the interior space, the chemicals capable of creating a chemo-luminescent reaction when combined; and c. catalyst means integrated into the plastic shell to initiate the chemo-luminescent reaction.

In another general aspect of the present invention, a method is provided for using the novelty item to enable children living in homes absent a chimney, fireplace or other structure typically considered to provide access by Santa Claus to the home, to practice a Christmas holiday tradition relying upon such a structural access means.

In a further aspect of the present invention, the novelty key can be personalized with a particular family name.

In a still a further aspect of the present invention, initiation of the chemo-luminescent reaction is initiated by imparting a twisting motion to an upper portion of the plastic shell (key bow), such that a glowing light radiates from the key, signifying that the "magical" glow effect will allow Santa Claus to gain entry into the house.

Yet another aspect of the present invention is the incorporation of an electrically induced light (such as an incandescent bulb, LED, and the like) as an illumination source for the Christmas Holiday key.

Yet another aspect of the present invention is the incorporation of an electrically induced light as an illumination source for the Christmas Holiday key, further comprising a portable power source and respective circuitry.

Yet another aspect of the present invention is the incorporation of an electrically induced light as an illumination source for the Christmas Holiday key, further comprising a portable power source and respective circuitry, wherein the portable power source is a battery.

Yet another aspect of the present invention is the incorporation of an electrically induced light as an illumination source for the Christmas Holiday key, further comprising a portable power source and respective circuitry, wherein the portable power source is a rechargeable battery.

Yet another aspect of the present invention is the incorporation of an electrically induced light as an illumination source for the Christmas Holiday key, further comprising a portable power source and respective circuitry, wherein the portable power source is a super capacitor.

Yet another aspect of the present invention is the incorporation of an LED light as an illumination source for the Christmas Holiday key, further comprising a battery and respective circuitry, wherein the battery is a button cell located within the upper section of the Christmas Holiday key.

Yet another aspect of the present invention is the incorporation of an LED light as an illumination source for the Christmas Holiday key, further comprising a battery and respective circuitry, wherein the battery is a cylindrical cell located within the lower section of the Christmas Holiday key.

Yet another aspect of the present invention is the incorporation of an audio recording device within the Christmas Holiday key.

Yet another aspect of the present invention is the incorporation of an audio recording and playback device within the Christmas Holiday key.

Yet another aspect of the present invention is the incorporation of an audio recording and playback device within the Christmas Holiday key, further comprising at least one of a speaker and a microphone.

Yet another aspect of the present invention is the incorporation of an audio recording and playback device within the Christmas Holiday key, further comprising at least one of a speaker and a microphone, wherein the at least one of speaker and microphone provide both sound acquisition and sound generation.

Yet another aspect of the present invention is the incorporation of an audio recording device within the Christmas Holiday key, wherein the audio recording device utilizes a digital recording components and memory.

Yet another aspect of the present invention is the incorporation of an audio recording device within the Christmas Holiday key, wherein the audio recording device utilizes digital recording components and a recorded message locking process, thus ensuring the message is never recorded over.

Yet another aspect of the present invention is the incorporation of an audio recording device within the Christmas Holiday key, wherein the audio recording device utilizes a digital recording components and a recorded message locking process, wherein the locking process is activated by depressing and holding the record activation device.

Yet another aspect of the present invention is the incorporation of an audio recording device within the Christmas Holiday key, wherein the audio recording device utilizes a digital recording components and a recorded message locking process, wherein the locking process is activated by depressing and holding the play activation device.

Yet another aspect of the present invention is the incorporation of an audio recording and playback device within the Christmas Holiday key, wherein the audio recording and playback device is operated by twisting the upper section (key bow) of the Christmas Holiday key.

Yet another aspect of the present invention is the incorporation of an audio recording and playback device within the Christmas Holiday key, wherein the audio recording and playback device is operated by a plurality of buttons located on the Christmas Holiday key.

Yet another aspect of the present invention is the incorporation of an audio recording and playback device within the Christmas Holiday key, wherein the audio recording and playback device is operated by a plurality of buttons located on the ribbon attached to the Christmas Holiday key.

Yet another aspect of the present invention is the incorporation of an audio recording and playback device within the Christmas Holiday key, wherein the audio recording and playback device allows for a plurality of recordings.

Yet another aspect of the present invention is a bow/key handle of the Christmas Holiday key having a shape/image in the likeness of a character.

Yet another aspect of the present invention is a bow/key handle of the Christmas Holiday key having a shape/image in the likeness of a character, wherein the character is selected form a character group, the character group comprising a Santa Claus image, a cartoon character, a puppet character, and the like.

Yet another aspect of the present invention is a bow/key handle includes features for holding and displaying a picture.

Yet another aspect of the present invention is the inclusion of an indicia presenting the year.

It is recognized that each of the above-identified aspects can be combined as desired into an embodiment of the present invention.

The term Santa can be considered as representative of all holiday personas. The most common holiday requiring a holiday persona have access to a residence is Christmas. It is understood that other scenarios might be applicable. The embodiments taught herein can be broadened to include other holidays such as Easter, and other holidays wherein a character would require access to a residence.

These and other objects, features, and advantages of the present invention will become more readily apparent from the attached drawings and the detailed description of the preferred embodiments, which follow.

BRIEF DESCRIPTION OF THE DRAWINGS

For the purpose of initially illustrating the invention, the specification presents drawings, flow diagrams, and embodiments that are presently preferred as well as alternates. It should be understood, however, that the invention is not limited to the specific instrumentality and methods disclosed herein. It can be recognized that the figures represent a layout in which persons skilled in the art may make variations therein. In the drawings.

Like reference numerals refer to like parts throughout the several views of the drawings.

DETAILED DESCRIPTION OF THE PREFERRED EMBODIMENTS

Shown throughout the figures, the present invention is generally directed to a chemo-luminescent holiday key, designed specifically to provide an explanation to children regarding how Santa Claus can visit their homes in the absence of a chimney fireplace or other typical entry means, while simultaneously providing a lighted decoration to display during the holiday season.

Figure 1:
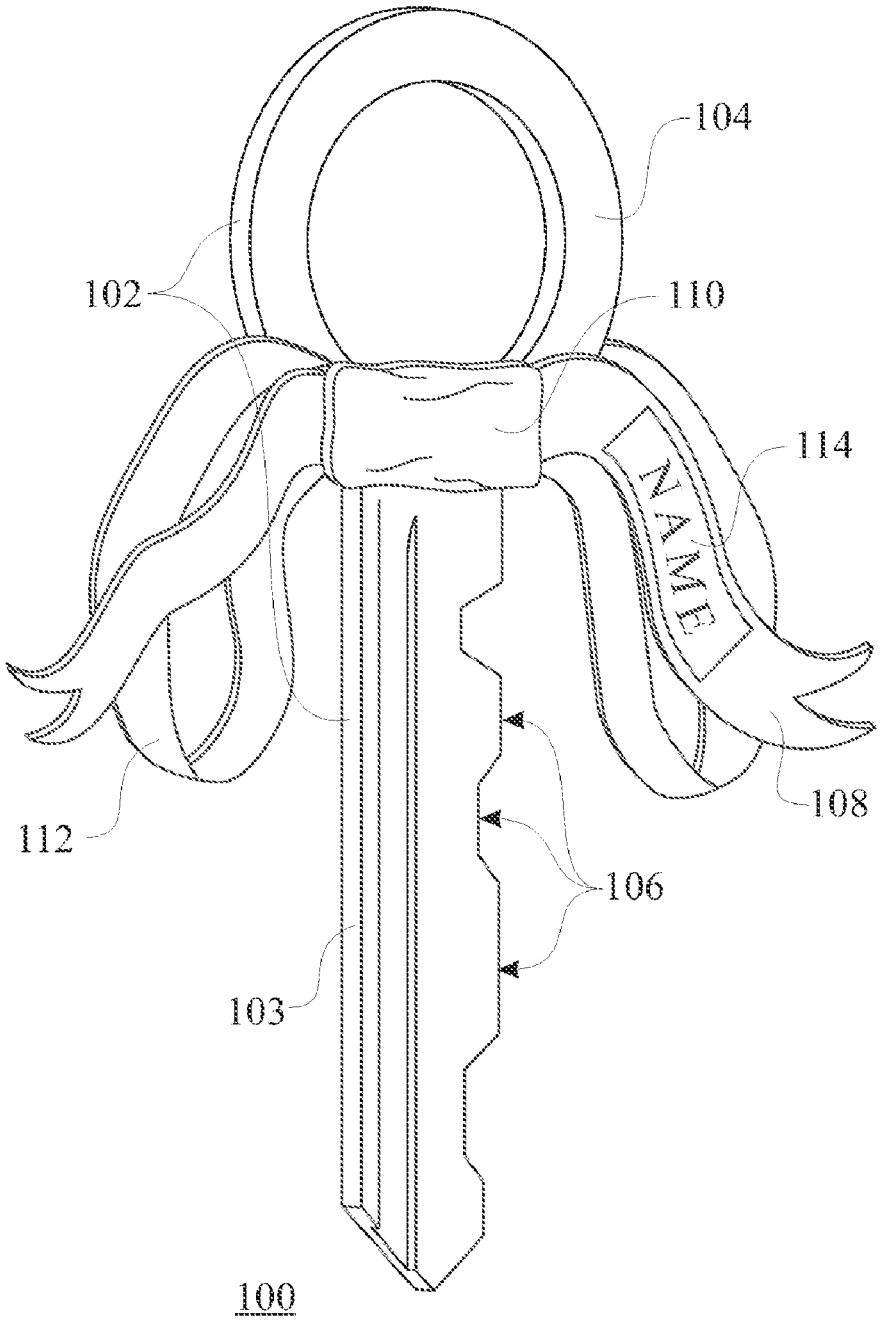
FIG. 1 illustrates a front view of a Christmas holiday key.

Referring now to FIG. 1, all the components that comprise the illuminating holiday key 100 are shown. The primary component of the illuminating holiday key 100 is the key 102. The key 102 includes a bow/key handle 104, which, with one embodiment of the present invention, when turned, activates the chemo-luminescent effect; a key blade/shaft portion 103, which is fabricated of a translucent material and glows once the illumination has been activated; and the teeth 106, which serve as a symbolic and decorative feature. A ribbon 108, provided wrapped about the key 102 and attached by securing means 110, is formed into decorative holiday bow loops 112. A nameplate 114 is provided to enable a user to display either their given or family name. The bow/key handle 104 can include additional features to hold and display a picture; i.e. a picture frame. Alternatively, the bow/key handle 104, which is illustrated as a simple circular shape, can be in intricate shapes or images representing the likeness of a character.

Figure 2:
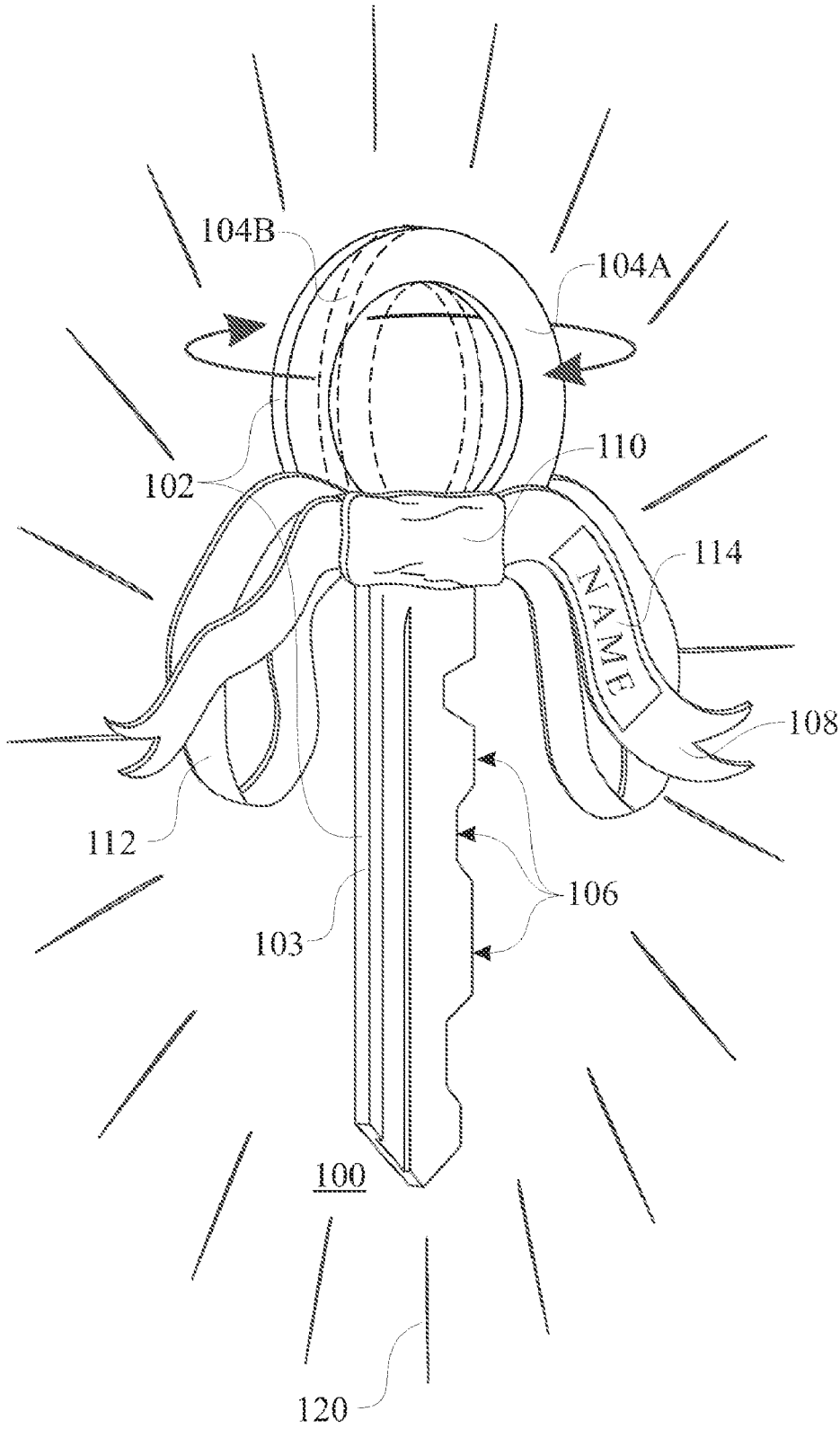
FIG. 2 illustrates a right perspective view of the Christmas holiday key, indicating how the top twists to activate the glowing effect.

Referring now to FIG. 2, the illuminating holiday key 100 is shown after the bow/key handle 104A (non-twisted orientation) has been twisted and is illustrated as bow/key handle 104A (twisted orientation). When the bow/key handle 104 is turned, a barrier between the reservoirs (breakable reservoir isolation member 134 of FIG. 5) located within the key 102 is broken, activating the chemo-luminescent. Chemo-luminescent refers to the chemical reaction that causes light to be emitted, illustrated as illumination 120, without an increase in temperature from the object emitting it—in this case, the key 102. When the barrier between the reservoirs is broken, a hydrogen peroxide solution activator (a first chemical composition) mixes with phenyl oxalate ester and a fluorescent dye (a second chemical composition) that creates the desired color. The activator can be stored in a thin glass capsule (not shown) within the interior space of the key 102. The body of the key 102 can be constructed from glass, plastic, rubber, or combinations thereof, or any of a wide variety of translucent materials, as long as the construction enables the bow/key handle 104 to be twisted in a manner that breaks the activator capsule (not shown).

Figure 3:
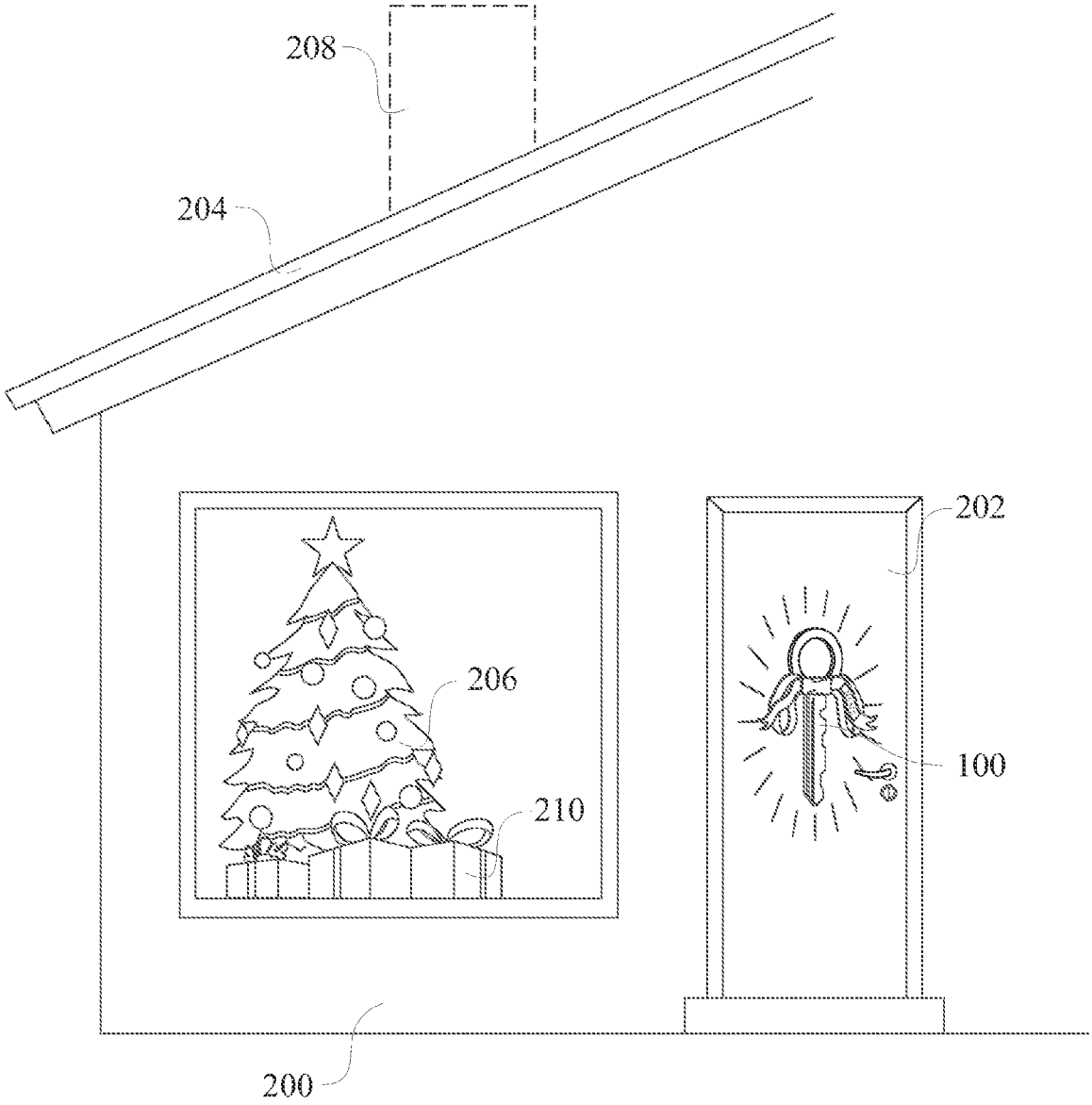
FIG. 3 illustrates a front view of the holiday key hanging on a household door, with the key shown activated.
Figure 4:
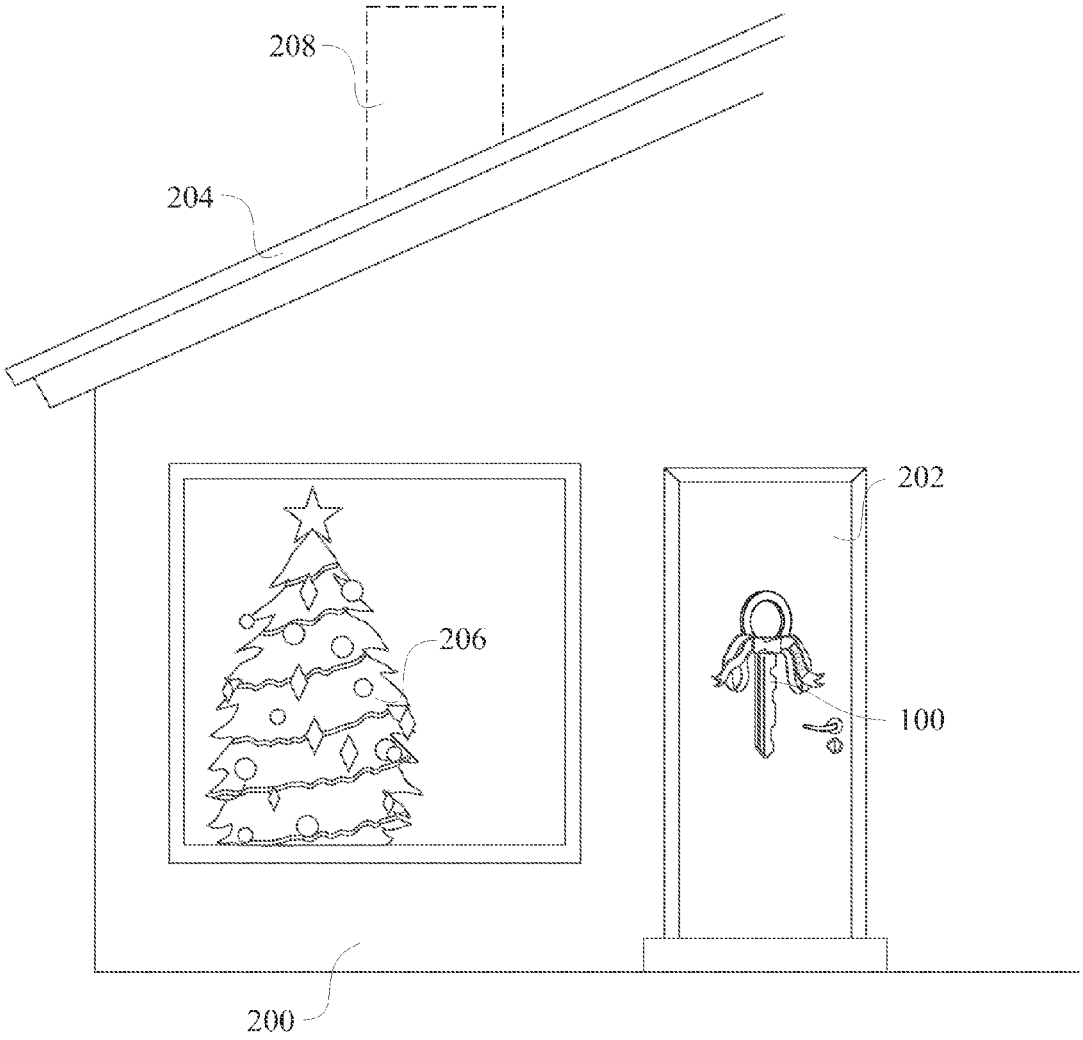
FIG. 4 illustrates a front view of the holiday key hanging on a household door, with the key shown non-activated.

FIGS. 3 and 4 illustrate the illuminating holiday key 100 hung on a door 202 of a house 200. In FIG. 3, the illuminating holiday key 100 bow/key handle 104 has been turned, emitting an illumination 120. This will indicate to the child that Santa Claus can now enter the premises and leave presents 210 under the Christmas Tree 206, without requiring roof 204 access via a chimney 208. It is noted that the chimney 208 is shown in phantom understanding that the chimney 208 is not actually available at the target residence. In FIG. 4, the bow/key handle 104 of the illuminating holiday key 100 has not been turned, and accordingly the glowing effect has not been activated. The illumination can be provided via the incorporation of any illuminating methods known by those skilled in the art. The holiday key 100 can be hung on any object along the outside of the house 200.

Figure 5:
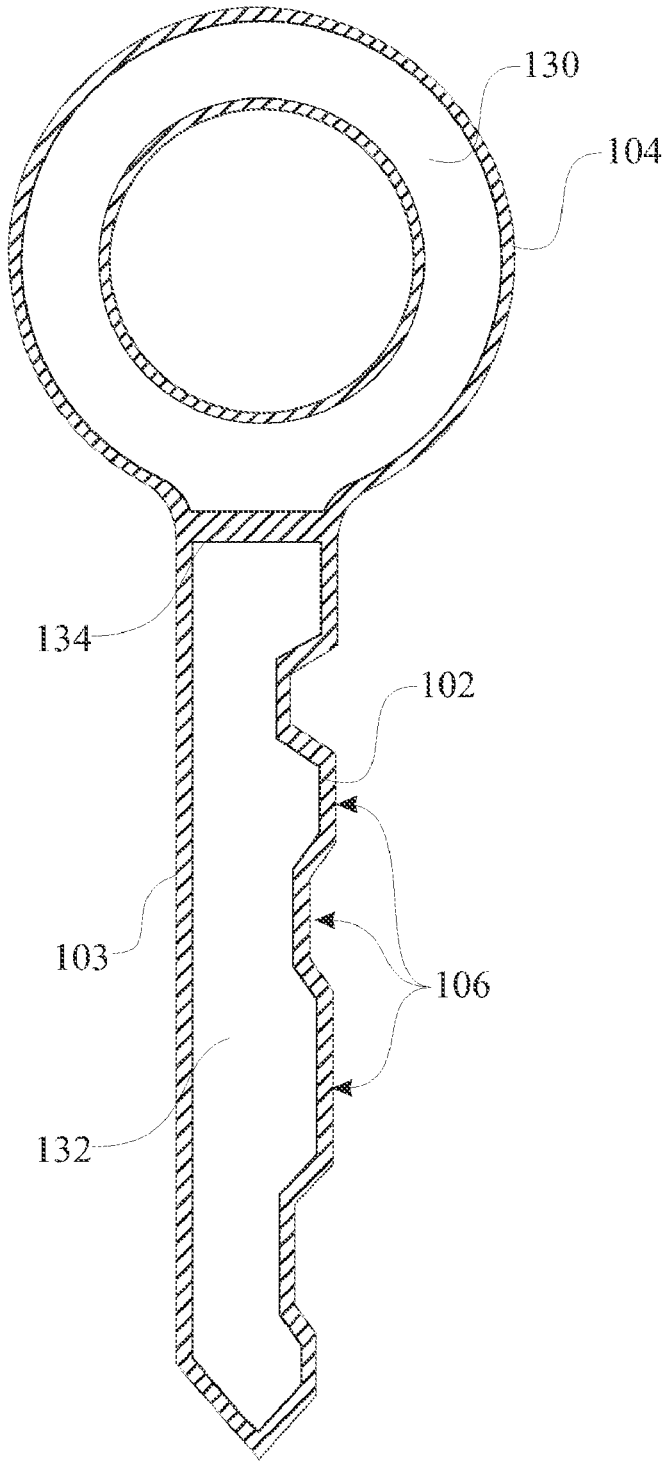
FIG. 5 illustrates a sectional, side view of the holiday key detailing a pair of chemo-luminescent reservoirs and a barrier between the pair of reservoirs.

FIG. 5 illustrates a cross sectional view of the illuminating holiday key 100, sectioned to illustrate the chemo-luminescent configuration. The illuminating holiday key 100 incorporates a first chemical reservoir 130 in the bow/key handle 104 and a second chemical reservoir 132 in a key blade/shaft portion 103, with the first chemical reservoir 130 and second chemical reservoir 132 separated by a breakable reservoir isolation member 134. The user would twist the bow/key handle 104 causing the breakable reservoir isolation member 134 to break, allowing a fluid chemistry within the first chemical reservoir 130 and second fluid chemistry in the second chemical reservoir 132 to mix resulting in a chemo-luminescent glow. Although the configuration shown is considered as a preferred embodiment at this time, it is recognized that other embodiments may be utilized to provide the same effect.

Figure 6:
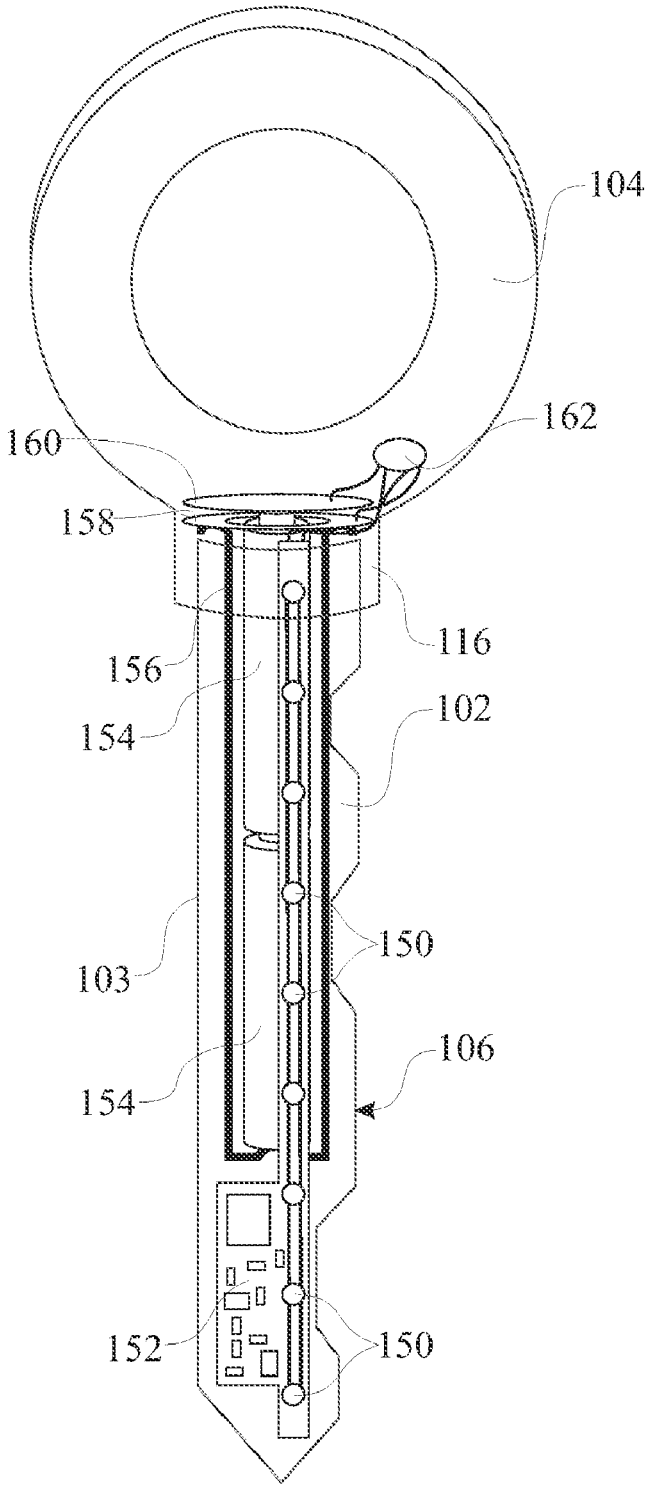
FIG. 6 illustrates a sectional side view of the holiday key detailing an electrically illuminating apparatus.

FIG. 6 illustrates an alternate embodiment of the illuminating holiday key 100, utilized an electrically induced illumination. The key blade/shaft portion 103 would be fabricated of a translucent material. The key blade/shaft portion 103 and the bow/key handle section 104 would be removably coupled via a ring-shaft coupling interface device 116. This provides access to components positioned with in the illuminating holiday key 100, such as the portable power source 154. The electrically induced illumination can be provided via a plurality of electrically induced lighting device(s) 150, with the electrically induced lighting device(s) 150 being assembled to a printed circuit assembly 152. The printed circuit assembly 152 is commonly known, utilizing conductive traces and electronic components assembled to a printed circuit board (PCB). The electronic components include the printed circuit assembly 152, and can additionally include passive components (capacitors, resistors, inductors), and active components (microprocessor, memory, diodes, transistors, and the like). Additionally, the printed circuit assembly 152 can include connectors, contacts, and other interfaces to remote components. A receiving section for a portable power source 154 is incorporated into the illuminating holiday key 100. One such embodiment utilizes two standard cylindrically shaped batteries such as "AAA" cells best located in the key blade/shaft portion 103. Alternately a button cell can be designed into the bow/key handle section 104. A ground or power contact and conductor 156 provides power connectivity (indirectly or directly) between the printed circuit assembly 152 and the portable power source 154. The illustrated configuration provides a ground power conductor interface 158 and a positive power conductor contact 160 for continuing the power connectivity of the circuit. A light activation switch 162 is incorporated, providing the user a device for controlling the state of activation of the illumination circuit, which illuminates the electrically induced lighting device(s) 150. Alternately a switch feature can be incorporated into a twisting motion of the bow/key handle 104. The switch would provide connectivity of power between the portable power source 154 and the circuit of printed circuit assembly 152, thus ultimately powering the plurality of portable power source 154. The circuit can include a control providing a variety of illumination modes, including simply on, flashing, a slow flash, a fast flash, a fixed message, and a programmed message, and the like. The exemplary embodiment provides one configuration. It is recognized that sufficient information is provided for one skilled in the art to design and fabricate the respective circuitry for any electrically induced illumination source while maintaining the spirit and intent of the present invention.

Figure 7:
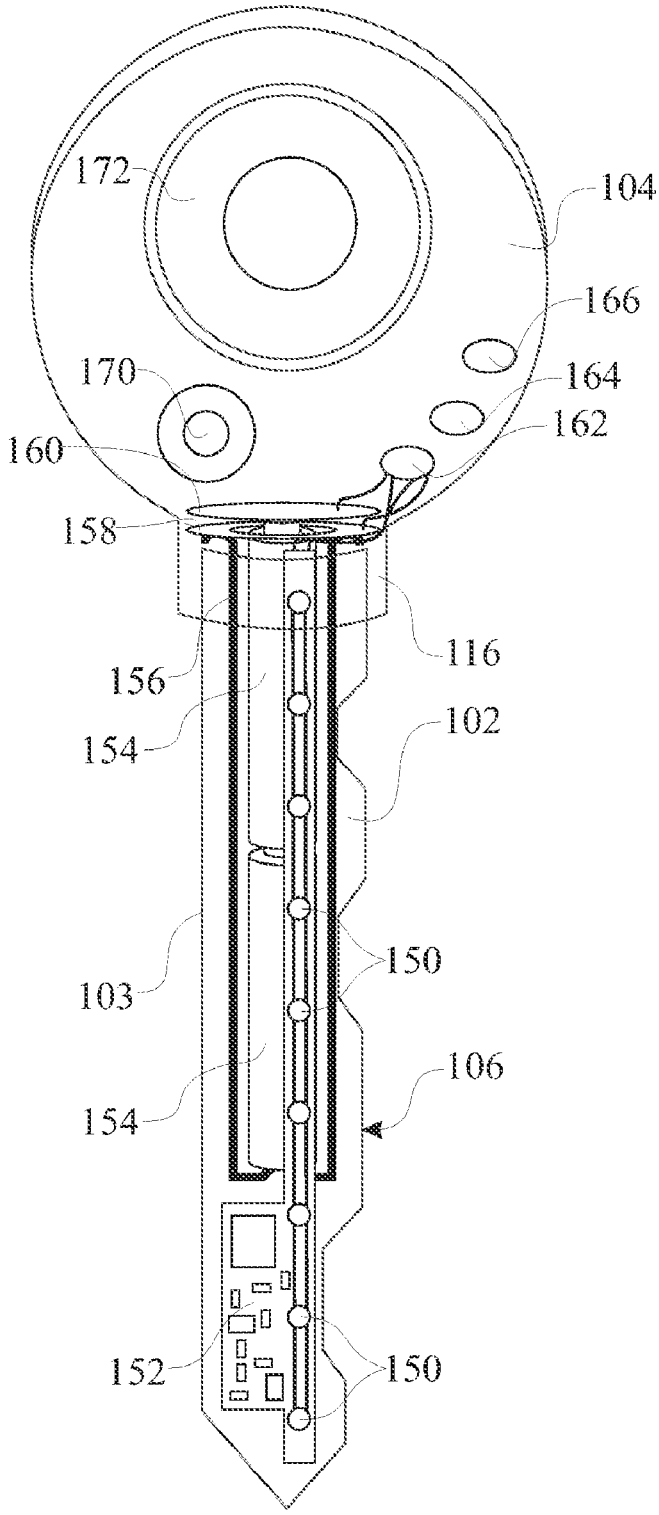
FIG. 7 illustrates a side view of a sectional side view of the holiday key detailing an electrically illuminating apparatus and audio recording/playback apparatus.

FIG. 7 presents the illuminating holiday key 100 incorporating the embodiment presented in FIG. 6, which supports the existence of a Santa Claus or other holiday persona, by additionally incorporating a sound recording and sound playback device. The sound recording apparatus includes a sound input device 170 for recording the desired sound and a sound output device 172 for replaying the desired sound. The child would place the illuminating holiday key 100 onto the door 202 of the house 200 before going off to sleep. When the child awakes, the child would obtain the illuminating holiday key 100 and press a playback activation switch 166. When the playback activation switch 166 is activated, the sound playback portion of the device would replay the message allegedly left by the "Santa Claus" persona. The "Santa Claus" persona would select a record activation switch 164 and record a message addressed to the child by speaking into a sound input device 170. The system would record the message, with the preferably embodiment being a digital recording circuit and respective memory device disposed onto the printed circuit assembly 152. Although one method of initiating a recording process would be by selecting the record activation switch 164, it is recognized that other means can be utilized for activating the recording process. One such alternate method comprising pressing both a record activation switch 164 and a playback activation switch 166 simultaneously, similar to that of a common cassette recording device. The record activation switch 164 and the playback activation switch 166 can be located with some distance between them ensuring that the user does not accidentally record over a previously recorded message. Additionally, it is desired that the recording be made such that it can't be recorded over. One exemplary method would be by holding down the record activation switch 164 for an extended period of time, such as 3 seconds. One can utilize an indicator such as five (5) beeps to indicate that the recording is being locked. This allows the user to stop the locking process prior to completion.

Figure 8:
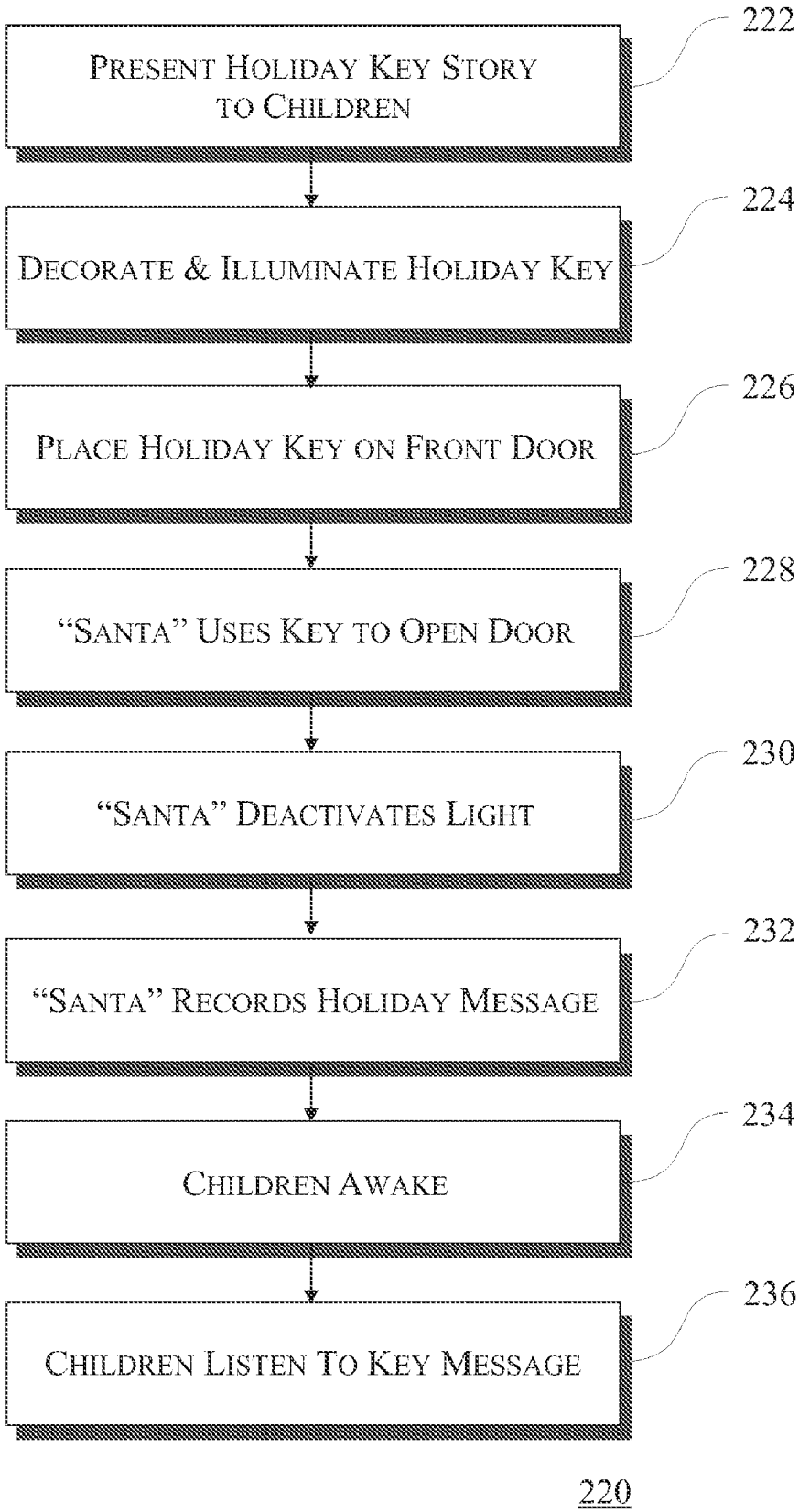
FIG. 8 presents a flow diagram illustrating the method of use of the holiday key.

FIG. 8 illustrates a holiday key method flow diagram 220, the holiday key method flow diagram 220 initiating with a holiday key storytelling step 222. The family would remind the children on the story describing the reason for the illuminating holiday key 100. During the storytelling step 222, the children would complete a holiday key preparation step 224, wherein the children can decorate the key with various decorative items such as ribbons, labels, and the like. The children would illuminate the illuminating holiday key 100 in accordance with the incorporated illumination means. The children can leave a message for Santa by using the audio recording device incorporated within the illuminating holiday key 100. When the preparations are complete, the illuminating holiday key 100 is mounted outside, being easily visible and accessible for Santa, such as in a place holiday key on doorstep 226. In accordance with the story, "Santa" would "magically" shrink the key to open the door, in accordance with a Santa uses the key to open the doorstep 228. It is understood that the door is actually opened by other means, wherein this step is incorporated in the spirit and intent of the supportive storyline. Continuing forward, Santa deactivates the light, as presented in a light deactivation step 230. This is accomplished in a method respective to the incorporated illumination design. If a chemo-luminescent material is utilized, time simply causes the illumination to diminish. If an electrically induced illumination is utilized, the switch would simply be turned off. Santa would then record a holiday message in accordance with a message-recording step 232. The message is recorded in accordance with the procedure associated with the respective recording device. Details of a message-recording step 232 are provided in FIG. 9 herein. The children wake up in the morning and rush towards the tree to enjoy the festive events that occurred overnight. This step is referenced as a children-waking step 234. The children do common Christmas morning tasks such as opening the presents, and the like, as well as recognizing that Santa came to visit as the symbolic holiday key is now inside the house and the illuminating holiday key 100 is no longer illuminated. The children have the joy of then listening to the message that Santa had left further adding to the holiday spirit, in accordance with a children listen to message recorded by holiday key step 236. This method maintains the family bond while supporting the existence of Santa Claus.

Figure 9:
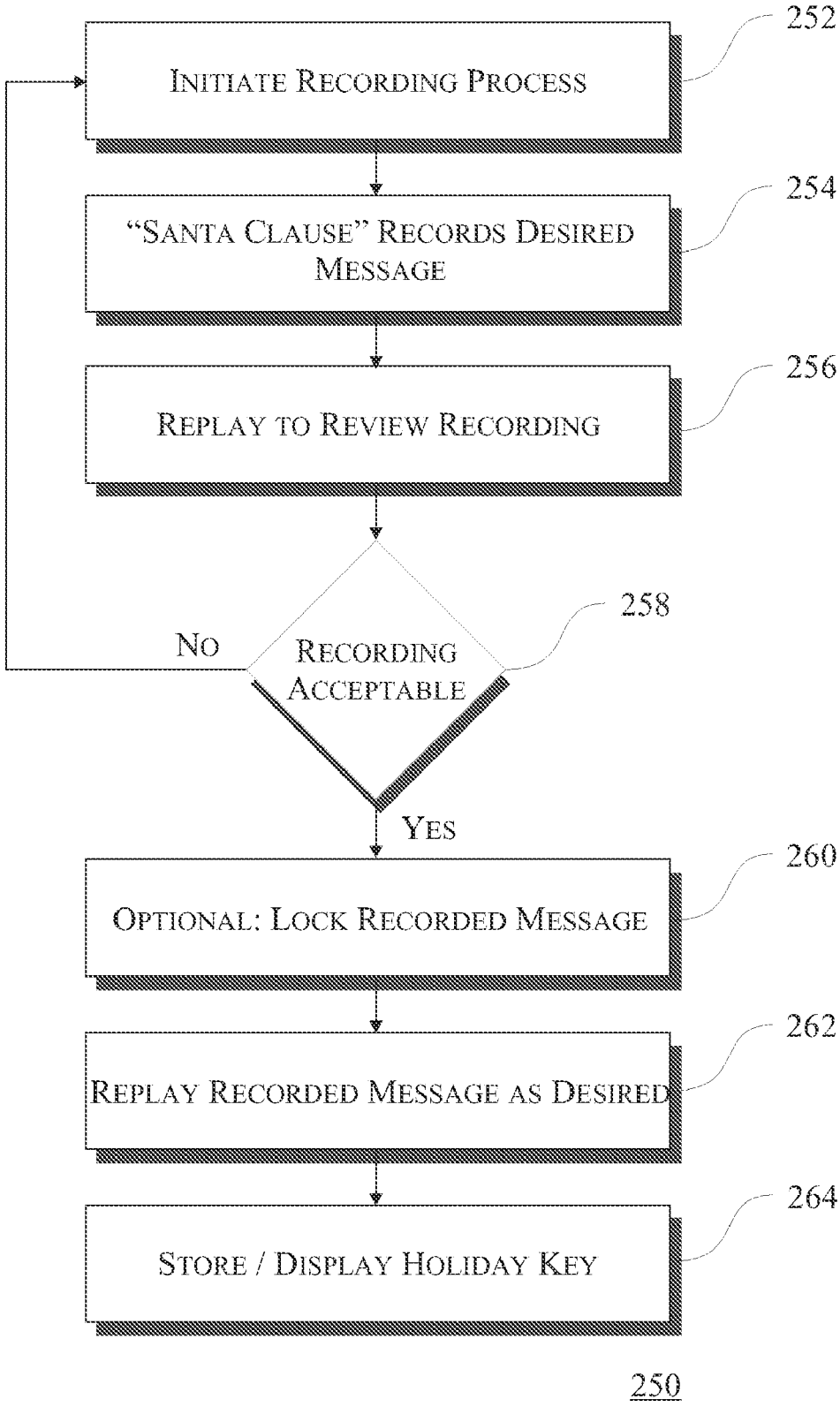
FIG. 9 presents a flow diagram illustrating the method of use of the recording device feature within the holiday key.

FIG. 9 illustrates a holiday key audio recording flow diagram 250, the holiday key audio recording flow diagram 250 initiating with a recording process initiation step 252. The party making the recording initiates the process by following the steps respective to the recording device deployed within the illuminating holiday key 100. One such step would be to depress both the record activation switch 164 and the playback activation switch 166. Another would be to simply depress or depress and hold the record activation switch 164. A personalized message from Santa Claus is then recorded in accordance with a recording Santa's personalized holiday message step 256. The message can be replayed to review the content and quality in accordance with a review recorded message step 256. The recording party considers a recording acceptable decision step 258 to determine if the recorded holiday message is acceptable. If not, the process returns to the recording process initiation step 252. If the message is acceptable, the user can optionally lock the recorded message as indicated by a locking recorded message step 260. The locking process can be initiated by any sequence of events. One such locking process can be initiated by depressing and holding the playback activation switch 166 for a predetermined length of time. For a digital recording, the software would identify that recorded message file as being locked. For a magnetic recording, a mechanical lock can be deployed. It is understood that a variety of locking processes can be used, of which, any such locking process should be considered as within the spirit and intent of the present invention. The children would then replay the recorded holiday message as desired in accordance with a replay recorded message step 262. The illuminating holiday key 100 is stored/displayed in accordance with a store Holiday key step 264.

Figure 10:
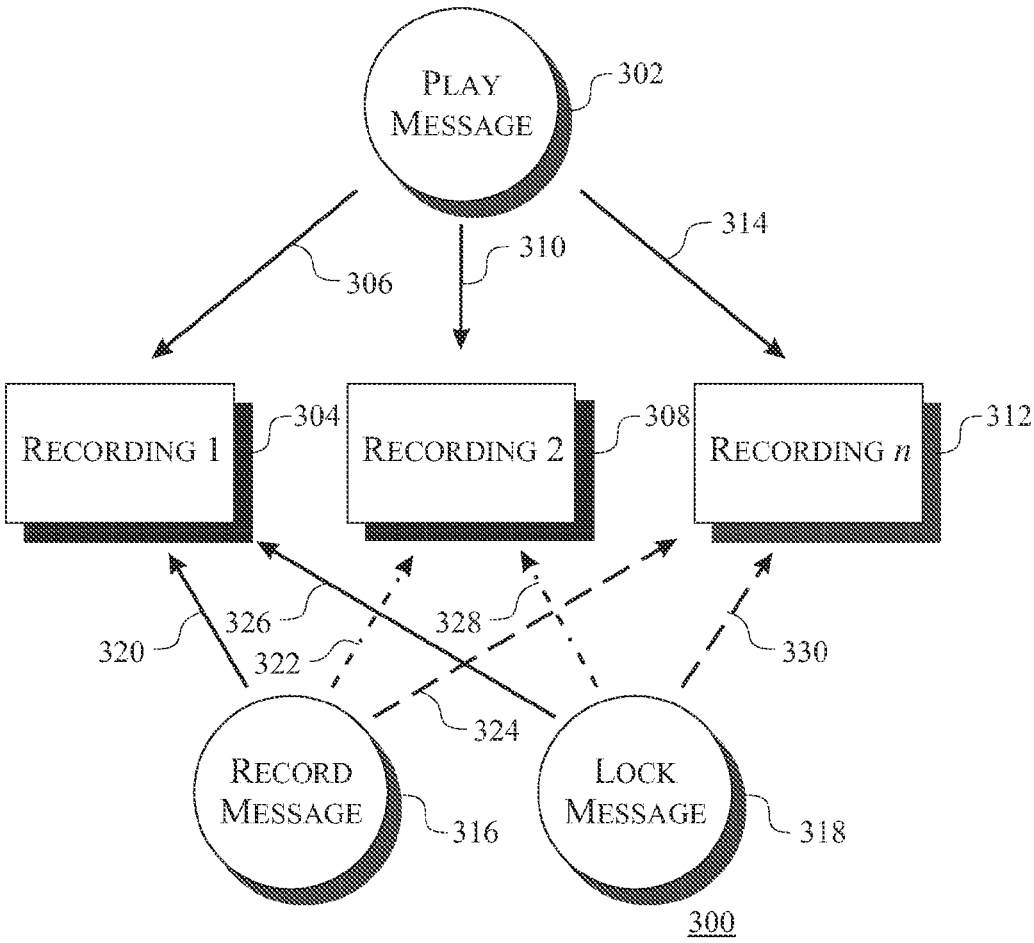
FIG. 10 presents a flow diagram illustrating the method of use of the optional recording device within the holiday key, providing a plurality of recordings.

FIG. 10 illustrates a detailed message-recording flow diagram 300. The message-recording flow diagram 300 presents the interactions between the various recording processes. The message-recording flow diagram 300 presents a recording system, which allows the user to record and lock a plurality of messages. This provides the illuminating holiday key 100 with the ability to record a message addressed to Santa from the children and a responding message from Santa to the children; year after year. The user would depress the playback activation switch 166 to request the recording/playback device to play the message 302. The user would depress the playback activation switch 166 the respective number of times to advance between a first recording 304, a second recording 308 and an $n^{th}$ recording 312. A single activation of the playback activation switch 166 would direct a single depressed playback request 306, playing the first recording 304; a second activation of the playback activation switch 166 would direct a second depressed playback request 310, playing the second recording 308; and this continues increasing as an nth activation of the playback activation switch 166, which directs an nth depressed playback request 314, playing the nth recording 312. The recording process differs slightly, as the indexing would consider any locked messages. The user would depress the record activation switch 164 to initiate a record message step 316. The recording/playback device of the illuminating holiday key 100 would direct a first recording activation 320 to record the first recording 304. If the first recording 304 is not locked, the next time the user depresses the record activation switch 164, the recording/playback device re-records the first recording 304. When the user activates the locking process 318, the recording/playback device locks the respective message. One such process would be wherein the message being locked is the one most recently played. An exemplary sequence is: the user selects the play message 302 which directs the single depressed playback request 306, playing the first recording 304; then the user selects the lock message 318 which directs a lock first recording request 326 causing the recording/playback device to lock the first recording 304. With the first recording 304 locked, the subsequent activation of the record message 316 would direct a second recording activation 322 to record the second recording 308. Similarly, the subsequent activation of the lock message 318 which directs a lock second recording request 328 causing the recording/playback device to lock the second recording 308. This sequence continues with an nth recording activation 324 and respective lock nth recording request 330 respective to the nth recording 312.

Since many modifications, variations, and changes in detail can be made to the described preferred embodiments of the invention, it is intended that all matters in the foregoing description and shown in the accompanying drawings be interpreted as illustrative and not in a limiting sense.

The Applicant has provided a method and apparatus, with several options, for a Christmas/Holiday Key and the method of using the Christmas/Holiday key for providing access to the residence for the entertainment of a child. Although the apparatus and methods taught herein are the preferred and alternate embodiments, it can be recognized that other form factors, materials, and methods of achieving the same results can be contrived from the disclosed teachings.

What is claimed is:

1. A holiday key entertainment method, the holiday key entertainment method comprising the steps of:

illuminating an illumination source, wherein the illumination source is located within a holiday key, the holiday key being an oversized key shaped apparatus comprising a key handle section and a key blade section;

securing the holiday key to an object on an outside of a residence; and informing a child that the holiday key is being placed outside such that a holiday persona can utilize the holiday key as a means for unlocking a door to the residence.

2. The holiday key entertainment method of claim 1, the holiday key entertainment method comprising the additional steps of:

deactivating the illumination of the illumination source within the holiday key; and placing the holiday key on an object located inside the residence.

3. The holiday key entertainment method of claim 2, creating the illumination by combining two different chemical compositions that are originally provided in two separate reservoirs within the holiday key to create a chemo-luminescent reaction.

4. The holiday key entertainment method of claim 2, wherein the step of combining the chemo-luminescent reaction is accomplished by twisting an key handle respective to a key blade portion of the holiday key, wherein the twisting action provides a means for combining for each of the two different chemical compositions that are originally provided in two separate reservoirs within the holiday key.

5. The holiday key entertainment method of claim 2, wherein the step of illuminating an illumination source is achieved by activating an electrically induced lighting, wherein the electrically induced lighting is provided by a portable power source, an electrical lighting circuit, and an electrically induced lighting device, all of which are assembled within the holiday key.

6. The holiday key entertainment method of claim 5, wherein the step of illuminating the electrically induced lighting is accomplished by twisting an key handle respective to the key blade portion of the holiday key, wherein the twisting action activates the electrical lighting circuit.

7. The holiday key entertainment method of claim 5, the holiday key entertainment method comprising the additional step of selecting an illumination mode, the illumination modes being at least one of: on, flashing, a slow flash, a fast flash, a fixed message, and a programmed message.

8. A holiday key entertainment method, the holiday key entertainment method comprising the steps of:

utilizing a holiday key, the holiday key being an oversized key shaped apparatus comprising a key handle section, a key blade section, and incorporating an audio recording and playback device within the holiday key;

securing the holiday key to an object on an outside of a residence; and informing a child that the holiday key is being placed outside such that a holiday persona can utilize the holiday key as a means for unlocking a door to the residence.

9. The holiday key entertainment method of claim 8, the holiday key entertainment method comprising the additional steps of recording a message using the audio recording and playback device within the holiday key and locking the recorded message.

10. The holiday key entertainment method of claim 8, the holiday key entertainment method comprising the additional step of a child recording a message for a holiday persona.

11. The holiday key entertainment method of claim 8, the holiday key entertainment method comprising the additional step of a holiday persona recording a message for a child.

12. The holiday key entertainment method of claim 8, the holiday key entertainment method comprising the additional steps of:

a child recording a message for a holiday persona, and a holiday persona recording a message for a child.

13. The holiday key entertainment method of claim 8, the holiday key entertainment method comprising the additional step of illuminating an illumination source, wherein the illumination source is located within a holiday key.

14. The holiday key entertainment method of claim 13, the holiday key entertainment method comprising the additional steps of:

deactivating the illumination of the illumination source within the holiday key; and placing the holiday key on an object located inside the residence.

15. The holiday key entertainment method of claim 13, creating the illumination by combining two different chemical compositions that are originally provided in two separate reservoirs within the holiday key to create a chemo-luminescent reaction.

16. The holiday key entertainment method of claim 13, wherein the step of illuminating an illumination source is achieved by activating an electrically induced lighting, wherein the electrically induced lighting is provided by a portable power source, an electrical lighting circuit, and an electrically induced lighting device, all of which are assembled within the holiday key.

17. A decorative oversized key-shaped holiday novelty item is provided, the decorative oversized key-shaped holiday novelty item comprising:

an oversized holiday key having a translucent plastic shell, the shell defining a completely encapsulated interior space;

wherein the oversized holiday key is adorned with at least one decorative holiday feature, the decorative feature being selected from a group comprising:

a) a holiday image, b) a character image, c) a cartoon character image, d) a holiday character image, e) a ribbon, f) an indicia presenting a year, g) a holding and displaying a picture, h) a puppet character; and at least one of:

an illumination source contained within the interior space; and an audio recording and playback apparatus contained within the interior space.

18. The decorative oversized key-shaped holiday novelty item of claim 17, the decorative oversized key-shaped holiday novelty item wherein the illumination source contained within the interior space comprising:

a first reservoir;

a second reservoir;

wherein the first reservoir and the second reservoir are separated by a barrier;

a first chemical composition stored in the first reservoir;

a second chemical stored in the second reservoir;

wherein when the first chemical composition and the second chemical are combined the combined chemical compositions create a chemo-luminescent reaction.

19. The decorative oversized key-shaped holiday novelty item of claim 17, the decorative oversized key-shaped holiday novelty item wherein the illumination source contained within the interior space comprising:

at least one electrically activated illumination device;

a portable power source; and an illumination circuit, wherein the illumination circuit provides power between the at least one electrically activated illumination device and the portable power source.

20. The decorative oversized key-shaped holiday novelty item of claim 17, the decorative oversized key-shaped holiday novelty item comprising the audio recording and playback apparatus contained within the interior space further comprising at least one of:

a software routine for locking a recorded message, and a hardware device for locking the recorded message, wherein said locked recorded message is unable to be at least one of erased, edited, and recorded over.

* * * * *